US009010872B2

(12) United States Patent
Lenaburg

(10) Patent No.: US 9,010,872 B2
(45) Date of Patent: Apr. 21, 2015

(54) TUNNEL BORING MACHINE WITH CUTTERHEAD SUPPORT ASSEMBLY SUPPORTING A VARIABLE NUMBER OF DRIVE SYSTEMS

(71) Applicant: The Robbins Company, Solon, OH (US)

(72) Inventor: Carl E. Lenaburg, Tacoma, WA (US)

(73) Assignee: The Robbins Company, Solon, OH (US)

( * ) Notice: Subject to any disclaimer, the term of this patent is extended or adjusted under 35 U.S.C. 154(b) by 45 days.

(21) Appl. No.: 13/925,647

(22) Filed: Jun. 24, 2013

(65) Prior Publication Data

US 2013/0341998 A1 Dec. 26, 2013

Related U.S. Application Data

(60) Provisional application No. 61/664,106, filed on Jun. 25, 2012.

(51) Int. Cl.
*E21D 9/11* (2006.01)
*E21D 9/10* (2006.01)

(52) U.S. Cl.
CPC ..... *E21D 9/112* (2013.01); *Y10T 29/49718* (2015.01); *E21D 9/1086* (2013.01)

(58) Field of Classification Search
CPC ..... E21D 9/11; E21D 9/112; E21D 9/081; E21D 9/1086
USPC ..... 299/55, 58, 59, 60, 61; 405/138
See application file for complete search history.

(56) References Cited

U.S. PATENT DOCUMENTS

| | | | | |
|---|---|---|---|---|
| 3,451,722 | A * | 6/1969 | Scaravilli et al. | 299/58 |
| 3,861,748 | A | 1/1975 | Cass | |
| 3,966,256 | A | 6/1976 | Fikse | |
| 3,967,463 | A | 7/1976 | Grandori | |
| 4,192,556 | A | 3/1980 | Grandori | |
| 4,193,637 | A * | 3/1980 | Spencer | 299/56 |
| 4,270,618 | A | 6/1981 | Owens | |
| 4,420,188 | A | 12/1983 | Robbins | |
| RE31,511 | E | 1/1984 | Spencer | |
| 4,494,799 | A * | 1/1985 | Snyder | 299/31 |
| 4,548,443 | A | 10/1985 | Turner | |

(Continued)

FOREIGN PATENT DOCUMENTS

| | | | |
|---|---|---|---|
| FR | 2602822 | A1 * | 2/1988 |
| JP | 11-256990 | A | 9/1999 |

(Continued)

*Primary Examiner* — David Bagnell
*Assistant Examiner* — Michael Goodwin
(74) *Attorney, Agent, or Firm* — Christenson O'Connor Johnson Kindness PLLC

(57) ABSTRACT

A tunnel boring machine (100) includes a cutterhead assembly (102) rotatably mounted to a forward shield assembly (116) through a cutterhead support assembly (110). The cutterhead support assembly is configured to receive a variable number of drive assemblies (105), such that the number of drive assemblies may be selected after fabricating the cutterhead support structure (120). The cutterhead support structure includes a housing portion (121) that houses the main bearing assembly (101) and a drive gear (104). A plurality of drive mount stations (111) provide access to the drive gear, and are provided with a pinion housing (130) for stations that receive a drive assembly, or with a cradle cover (140) for stations that do not receive a drive assembly.

19 Claims, 6 Drawing Sheets

(56) References Cited

U.S. PATENT DOCUMENTS

| | | | | |
|---|---|---|---|---|
| 4,637,657 | A * | 1/1987 | Snyder | 299/31 |
| 4,818,026 | A * | 4/1989 | Yamazaki et al. | 299/56 |
| 5,205,613 | A | 4/1993 | Brown, Jr. | |
| 5,890,771 | A * | 4/1999 | Cass | 299/31 |
| 6,347,838 | B1 | 2/2002 | Mukaidani | |
| 6,431,653 | B1 | 8/2002 | Kleuters | |
| 7,832,960 | B2 | 11/2010 | Home | |
| 8,172,334 | B2 | 5/2012 | Lindbergh | |
| 2010/0148566 | A1 * | 6/2010 | Home et al. | 299/31 |
| 2011/0031017 | A1 | 2/2011 | Iwata | |
| 2012/0212034 | A1 | 8/2012 | Shanahan | |

FOREIGN PATENT DOCUMENTS

| | | | |
|---|---|---|---|
| JP | 2004-211477 | A | 7/2004 |
| JP | 2005-002631 | A | 1/2005 |

* cited by examiner

TUNNEL BORING MACHINE WITH CUTTERHEAD SUPPORT ASSEMBLY SUPPORTING A VARIABLE NUMBER OF DRIVE SYSTEMS

CROSS-REFERENCE TO RELATED APPLICATION

This application is a claims the benefit of Provisional Application No. 61/664,106, filed Jun. 25, 2012, the disclosure of which is hereby incorporated by reference herein.

BACKGROUND

A tunnel boring machine ("TBM") is a tunnel excavation apparatus for constructing a tunnel or passageway through soil and rock strata. Typical conventional TBMs produce a smooth circular tunnel wall, typically with minimal collateral disturbance.

An early tunneling machine is disclosed in U.S. Pat. No. 17,650, to Wilson, and includes a large wheel with outboard scrapers and cutter wheels designed to bore an outer ring groove and a central cutting member that bores a small central hole. Wilson teaches exploding a charge of gunpowder in the central hole to detach rock intervening between the central hole and the ring groove.

A breakthrough that made TBMs efficient and reliable was the invention of the rotating head with rotatable cutter assemblies, developed by James S. Robbins, who later founded the Robbins Company. Initially, Robbins designed a TBM that used strong spikes that were mounted to a rotating cutterhead. However the TBM had the problem that the spikes would break frequently, resulting in expensive downtime. He discovered that by replacing these grinding spikes with longer lasting rotating cutter assemblies this problem was significantly reduced. Since then, successful modern TBMs have rotating cutter assemblies.

An early version of Robbins' rotating cutter TBM was able to cut 160 feet in 24 hours in shale, ten times faster than any other method at that time. The design was first used successfully at the Humber River Sewer Tunnel in 1956, and since then, substantially all modern hard rock tunnel boring machines use rotating cutting wheels with circular disc cutters.

Modern tunnel boring machines use a rotating cutterhead assembly having a plurality of disc-type cutter assemblies rotatably mounted on a front face of the cutterhead. The cutterhead assembly is pushed with great force against the rock face and rotated such that the cutter assemblies loosen, fracture, and/or break up the ground or rock face. The cutterhead assembly may also include other cutting components, for example, scrapers and the like. As the cutterhead is rotated and pressed against the strata, the fractured and loosened material passes through the cutterhead assembly and is deposited onto a conveyor system and transported to the rear of the machine for removal. The modern TBM typically uses a hydraulic gripper system that pushes against the side walls of the tunnel to urge the cutterhead assembly against the rock face, and to propel the TBM forward.

In fractured rock, shielded hard rock TBMs can be used, which erect concrete segments to support unstable tunnel walls behind the machine. Double shield TBMs will generally be operable in two modes, depending on the application. In stable ground, a double shield TBM will grip or react against the tunnel walls to advance the TBM. In unstable, fractured ground, the thrust forces are shifted to thrust cylinders that push off against the tunnel segments behind the machine.

The tunnel size for TBMs typically is in the range of from about a meter in diameter to 19 meters or more. The largest diameter hard rock TBM is believed to be the so-called "Big Becky" manufactured by The Robbins Company to bore a 14.4 meter hydroelectric tunnel beneath Niagara Falls for Canada's Niagara Tunnel Project. Larger TBMs have been constructed for boring through soft ground including sand and clay.

TBMs have the advantage of limiting the disturbance to the surrounding ground (as opposed to conventional drilling and blasting methods), and producing a smooth tunnel wall. In particular, TBMs are often suitable for use even in populated areas. However, the major disadvantage is the large up front costs associated with TBMs. TBMs are expensive machines. The high costs are due, in part, to the fact that a TBM is typically custom designed based on the requirements for a particular project. For example, the power requirements for rotatably driving the cutterhead assembly will depend on aspects of a particular project such as the size of the tunnel, the material to be bored through, and the ground conditions. Such custom design and fabrication requires significant lead times, which can contribute to the critical path for completion of a project. It would be beneficial to improve the TBM to reduce the costs of the machine, to shorten the lead time for production, and to allow for re-use and repurposing of a TBM.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A tunnel boring machine includes a cutterhead assembly rotatably coupled to a forward shield assembly with a cutterhead support assembly. The cutterhead support assembly includes a support structure with a housing portion and a plurality of drive mount stations, each with a pinion port and cradle assembly. A plurality of pinion housings are mounted to the support structure at some of the drive mount stations, and at least one cradle cover is attached at one of the drive mount stations. A ring gear is attached to a main bearing assembly in the support structure, and an attachment structure connects the ring gear to the cutterhead support. A plurality of drive assemblies engage the ring gear at respective drive mount stations. The cutterhead support assembly is configured to engage a variable number of drive systems, such that the torque capabilities of the tunnel boring machine may be decided after construction of the cutterhead support structure.

In an embodiment, the forward shield assembly includes a cylindrical support, and the cutterhead support structure includes a plurality of radial plates that are configured to engage the cylindrical support, for example, through a plurality of shear plates, such that the cutterhead support assembly is removable. In an embodiment, each of the drive mount stations is disposed between two of the plurality of radial plates.

In an embodiment, the ring gear is attached to the cutterhead assembly with an attachment structure that includes a mounting ring fixed to the ring gear, and a plurality of pedestal legs that connect the mounting ring to the cutterhead assembly.

In an embodiment, the cutterhead support assembly is configured to receive up to eight drive assemblies; in another embodiment, the cutterhead support assembly is configured to receive up to eighteen drive assemblies.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

An exemplary TBM in accordance with the present invention will be described with reference to the Figures, wherein like numbers indicate like parts. A prior art tunnel boring machine is disclosed in U.S. Pat. No. 4,420,188, to Robbins et al., which is hereby incorporated by reference in its entirety. Reference is also made to U.S. Pat. No. 4,548,443, to Turner, which is also incorporated by reference in its entirety.

Figure 1:
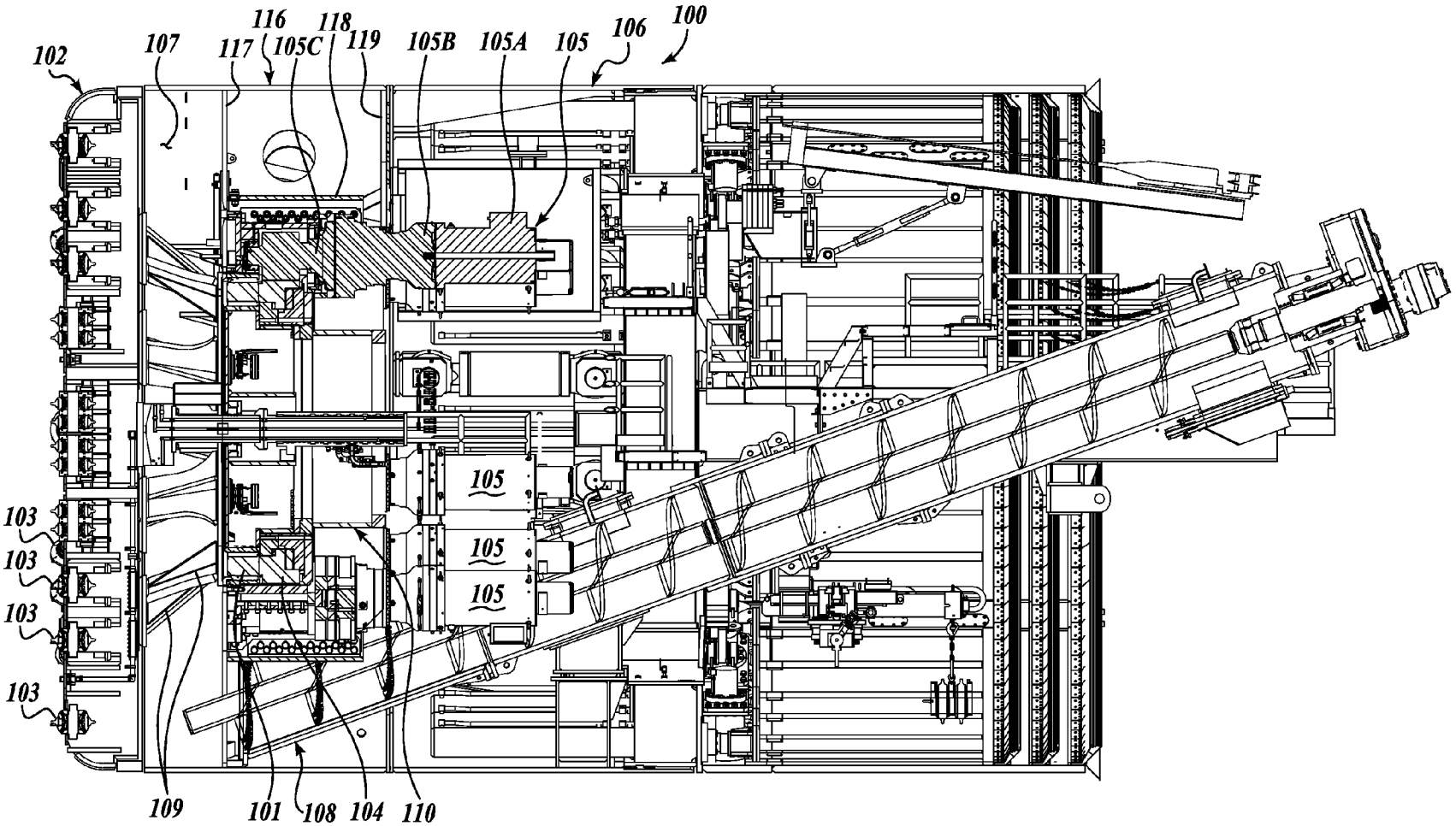
FIG. 1 is a side sectional view of a tunnel boring machine having a cutterhead support assembly in accordance with the present invention.

A side sectional view of a TBM 100 in accordance with the present invention is shown in FIG. 1. The TBM 100 has a rotatable cutterhead assembly 102 at a front end. A plurality of excavating assemblies, for example free-rotating cutter assemblies 103, are mounted in, and extend from, the front face of the cutterhead assembly 102.

The cutterhead assembly 102 is rotatably attached to a forward shield assembly 116, which includes a vertical pressure bulkhead 117, an aft wall 119, and a cylindrical support 118 mounted horizontally therebetween. The region between the cutterhead assembly 102 and the bulkhead 117 is the mixing chamber 107. Regolith and other materials loosened by the cutterhead assembly 102 passes through apertures in the cutterhead assembly 102 and into the mixing chamber 107, where it is transported rearwardly by a conveyor system, for example a screw conveyor 108.

A rear shield assembly 106 extends rearwardly from the forward shield assembly 116. The screw conveyor assembly 108 for removing excavated material extends from a collection region in the mixing chamber 107 through the forward shield assembly 104 and rear shield assembly 106. The screw conveyor assembly 108 typically deposits excavated materials onto secondary conveyors (not shown).

A pedestal, comprising a plurality of pedestal legs 109, attaches the cutterhead assembly 102 to a cutterhead support assembly 110 disposed in the forward shield assembly 116. The pedestal legs 109 attach to a ring gear 104 through a main bearing and seal assembly 101 that is rotatably mounted in the cutterhead support assembly 110. The cutterhead support assembly 110 is securely and releasably attached to the cylindrical support 118 and to the pressure bulkhead 117.

A drive system for the ring gear 104 includes a plurality of drive assemblies 105, each drive assembly including a motor 105A, a gear box 105B, and a pinion assembly 105C. The plurality of drive assemblies 105 cooperatively drive the ring gear 104, thereby rotating the cutterhead assembly 102. It will be appreciated that the number of drive assemblies 105 required for a particular TBM will depend on the application, including, for example, the diameter of the cutterhead assembly 102 and the properties of the materials the TBM is intended to bore a tunnel through.

Conventional aspects of the TBM 100, and aspects not relevant to the present invention, will not be further described herein for brevity and clarity.

Figure 2:
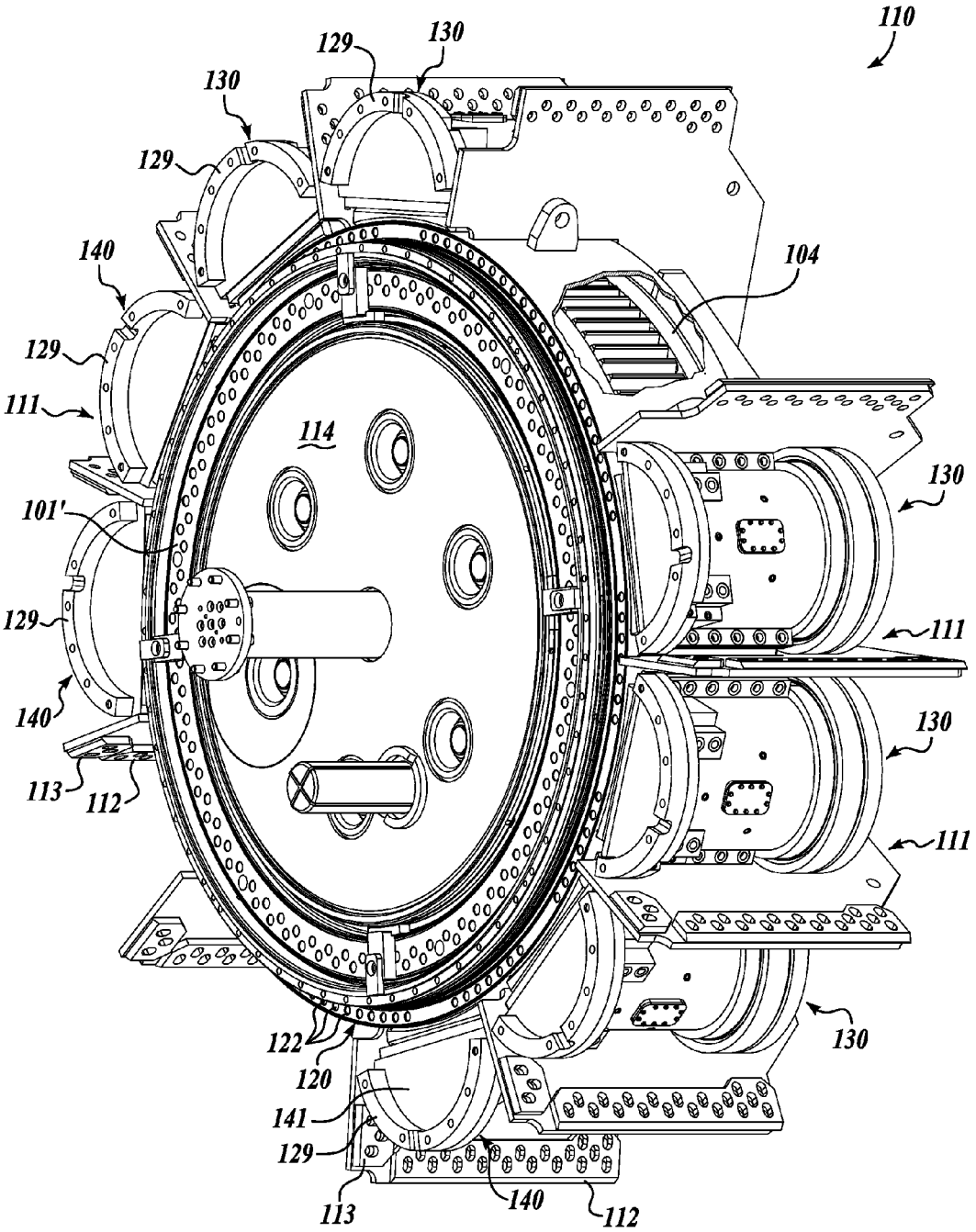
FIG. 2 is a perspective view of a cutterhead support assembly for the tunnel boring machine shown in FIG. 1.
Figure 3:
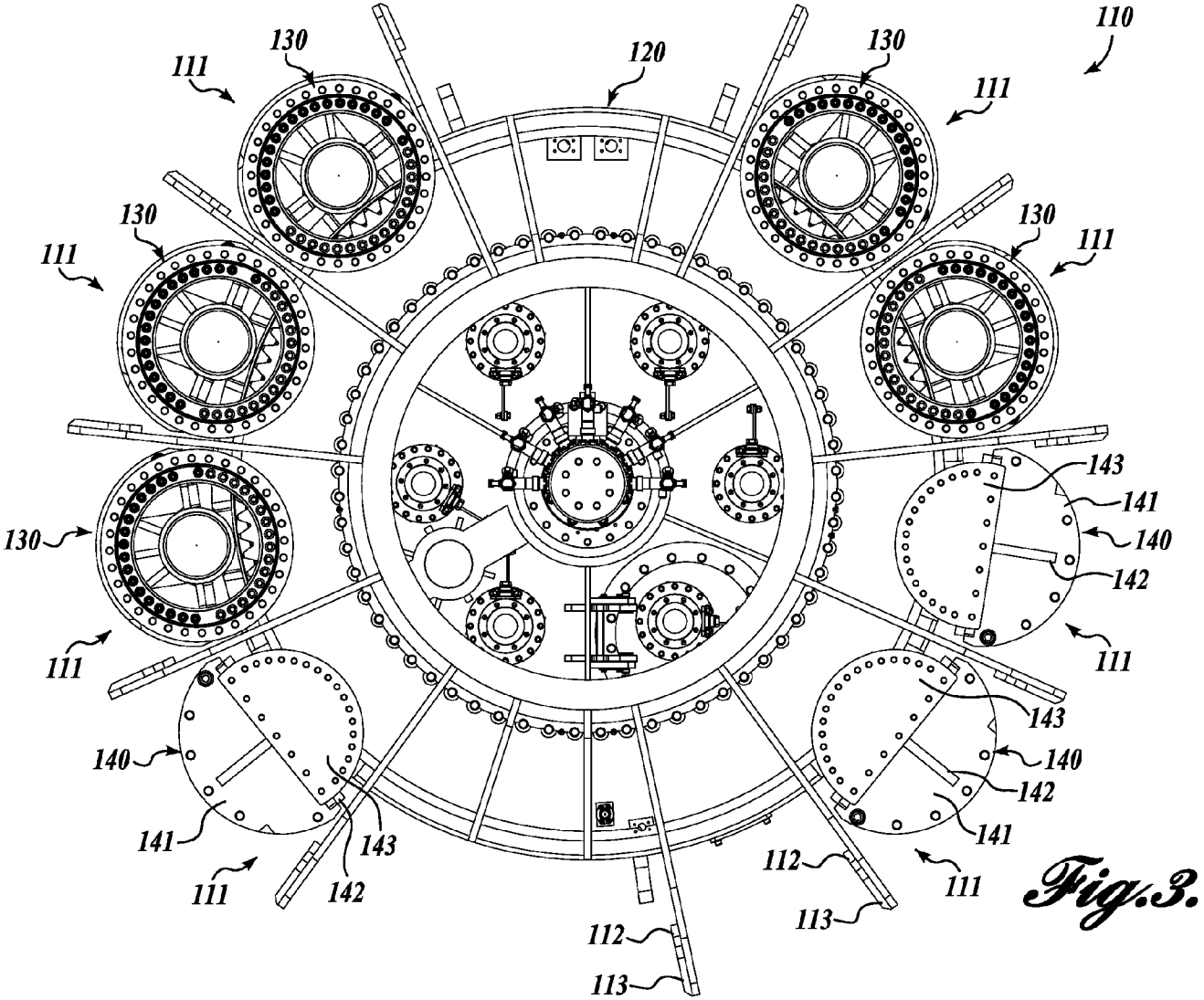
FIG. 3 is a rear view of the cutterhead support assembly shown in FIG. 2.

A front-right perspective view of the cutterhead support assembly 110 is shown in isolation in FIG. 2 with a small cutaway exposing the ring gear 104. A rear view of the cutterhead support assembly 110 is shown in FIG. 3. The cutterhead support assembly 110 includes a novel cutterhead support structure 120 that is configured to accommodate a selectable number of drive assemblies 105. In this exemplary embodiment, the cutterhead support assembly 110 has eight drive mount stations 111, and is intended to accommodate 4, 5, 6, 7, or 8 drive assemblies 105. The cutterhead support assembly 110 is shown with five of the mount stations 111 configured to receive a drive assembly 105. Although a cutterhead support assembly 110 with eight drive mount stations 111 is shown, it will be apparent to persons of skill in the art that a cutterhead support assembly in accordance with the present invention may be designed with an arbitrary number of drive mount stations.

The cutterhead support structure 120 supports the main bearing and seal assembly 101 (only the mounting ring 101' visible) that rotatably attaches the rotating cutterhead support structure 120 to the rotating cutterhead assembly 102 through the pedestal legs 109 (FIG. 1). The ring gear 104 is fixed to the mounting ring 101' and is driveably disposed in the cutterhead support structure 120 behind a center bulkhead assembly 114. The ring gear 104 is configured to be rotatably driven by the drive assemblies 105, which engage the ring gear 104 through pinion assemblies 105C supported in pinion housings 130 at the corresponding mount station 111. In the current embodiment, the ring gear 104 has outwardly disposed teeth, although it will be readily apparent that with straightforward changes other drive mechanisms, for example a ring gear with internally-disposed teeth, may alternatively be used. The mount stations 111 without corresponding drive assemblies 105 are provided with a cradle cover 140.

Figure 4:
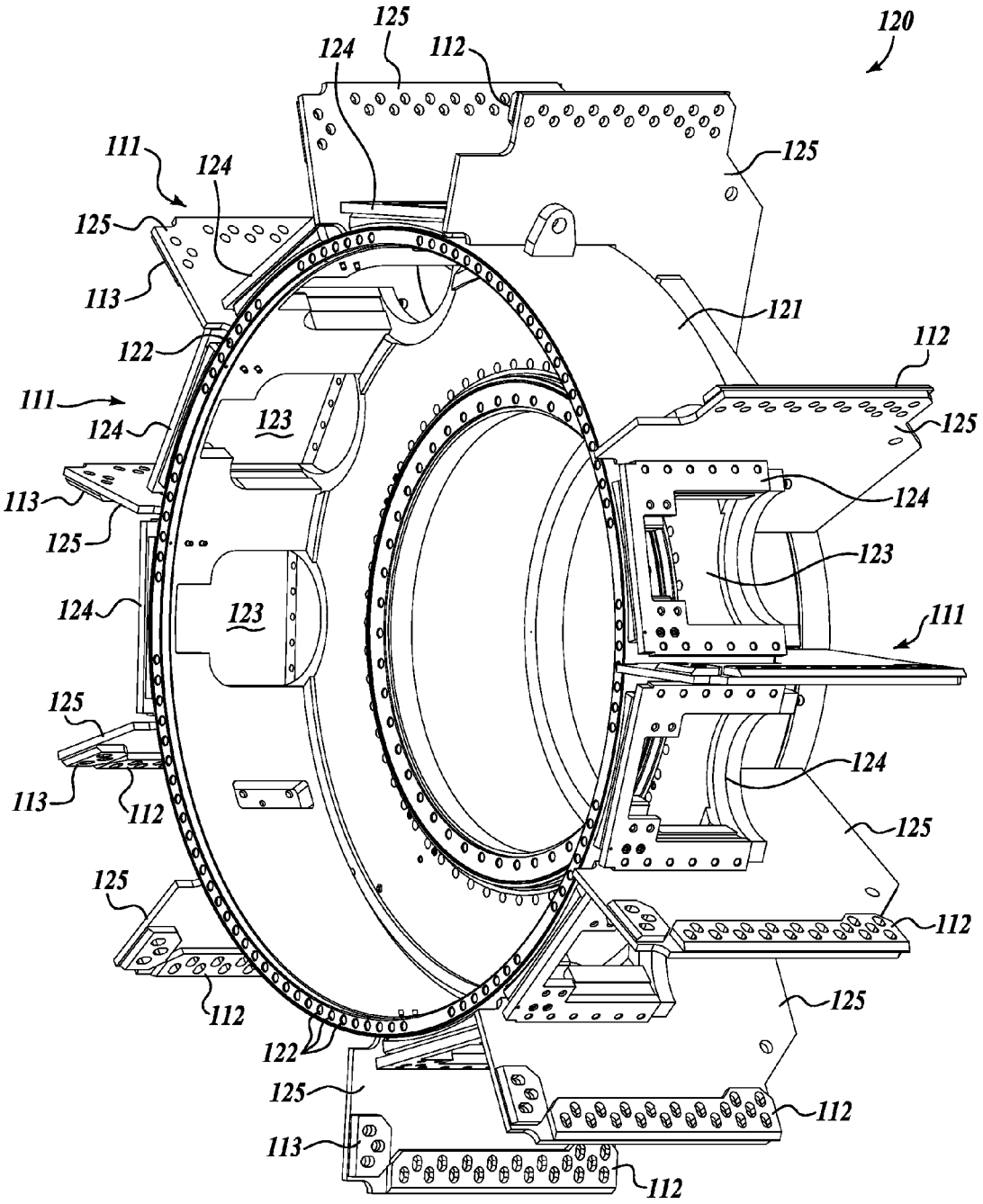
FIG. 4 is a perspective view of the cutterhead support structure for the cutterhead support assembly shown in FIG. 2.

A perspective view of the cutterhead support structure 120 is shown in isolation in FIG. 4. The cutterhead support structure 120 is a large, heavy structure and includes a generally cylindrical forward housing portion 121. A plurality of threaded apertures 122 are formed in the front perimeter of the forward housing portion 121 for attaching the cutterhead support structure 120 to the pressure bulkhead 117. Pinion entry ports 123 extend through the forward housing portion 121 at each of the drive mount stations 111. A pinion gear support cradle 124 is also provided on the outer side of the forward housing portion 121 at each drive mount station 111.

A plurality of spaced-apart radial support plates or ribs 125 extend outwardly from the forward housing portion 121 of the cutterhead support structure 120. Some of the radial support plates 125 delineate the drive mount stations 111. The radial support plates 125 include a number of apertures for attachment of outer shear plates 112 and front shear plates 113. The shear plates 112, 113 are for removably attaching the cutterhead support structure 120 to the TBM 100. In a current embodiment, the outer shear plates 112 are welded to the cylindrical support 118 (FIG. 1) and the front shear plates 113 are welded to the pressure bulkhead 117. The cutterhead support structure 120 is then removably bolted into the forward shield assembly 116.

Figure 5:
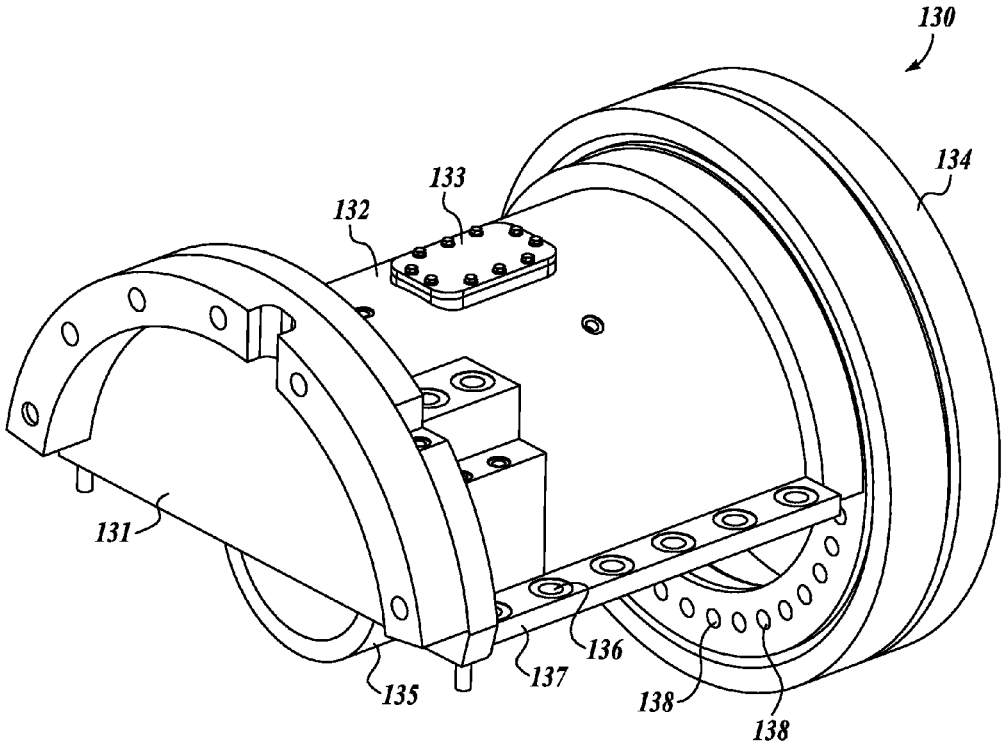
FIG. 5 is a perspective view of a pinion housing for the cutterhead support assembly shown in FIG. 2.

FIG. 5 shows a perspective view of the pinion housing 130, which includes a generally semicircular front plate 131 configured to bolt to a tap pad 129, a semi-tubular body portion 132, and a rear drive mount 134. A pair of oppositely disposed flanges 137 (one visible) define apertures 136 for attaching the pinion housing 130 to the pinion gear support cradle 124. Apertures 138 through the rear drive mount 134 are provided for further attaching the pinion housing 130 to the cutterhead support structure 120. A pinion shaft end support 135 extends downwardly from a front portion of the housing 130. An optional inspection port cover 133 is removably attached to the top of the body portion 132.

As seen most clearly in FIG. 3, drive mount stations 111 without a corresponding drive assembly 105 are provided with a cradle cover 140. The cradle cover 140 includes a front plate 141 similar to the pinion housing front plate 131, a cover plate with a center support 142 that bolts to the pinion gear support cradle 124, and a rear cover 143 that bolts to the cutterhead support structure 120. The cover plate 142 and rear cover 143 close the corresponding pinion entry port 123.

Tap pads 129 and the front shear plates 113 shown in FIGS. 2 and 3 are configured to be welded to the pressure bulkhead 117, and the outer shear plates 112 are configured to be welded to the cylindrical support 118 during assembly of the TBM 100. Therefore, in the present embodiment the cutterhead support assembly 110 is securely installed in the forward shield assembly 116 by bolting it to the shear plates 112, 113, and to the tap pads 129, and through bolts that engage threaded apertures 122 in the front end of the cutterhead support structure 120.

The cutterhead support assembly 110 can advantageously be disengaged from the forward shield assembly 116 by removing the appropriate bolts. The ability to detach the cutterhead support assembly 110 provides a number of advantages not found in prior art tunnel boring machine, including maintenance, repurposing and recycling components, and the like, as discussed below.

The number of drive assemblies needed or preferred for a particular application will be determined by the torque and power requirements for the project, which may depend on factors such as the size of the tunnel (i.e., the diameter of the cutterhead assembly 102), the rock and/or other substrate to be encountered, the ground conditions, etc. For example, a 6-meter diameter tunnel through softer ground may require only 4 drive assemblies, and a 6.5-meter diameter tunnel might require 5 drive assemblies, or if hard rock is to be encountered, 6, 7, or 8 drive assemblies may be needed.

Figure 6:
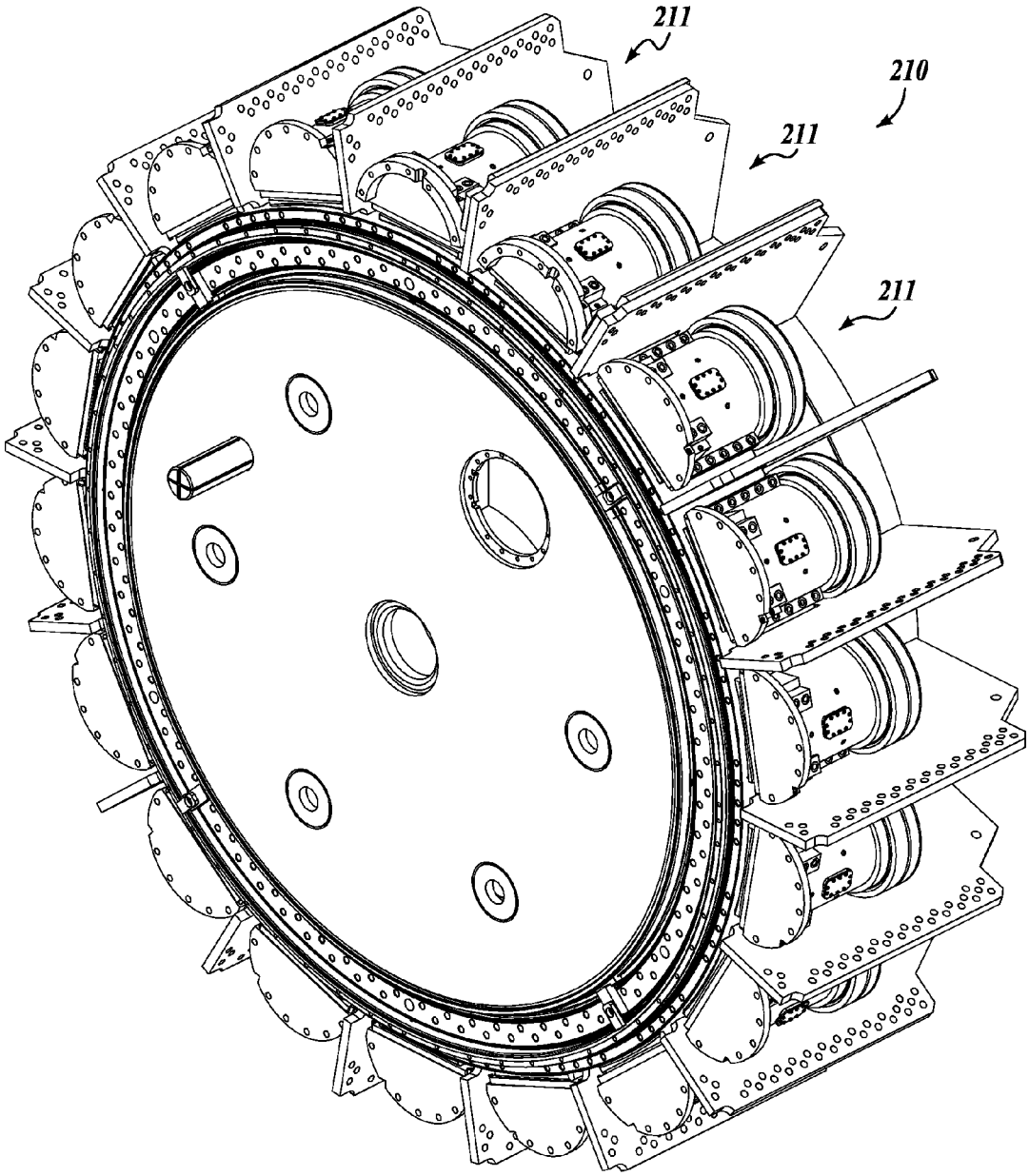
FIG. 6 is a perspective view of a second embodiment of a cutterhead support assembly in accordance with the present invention.

FIG. 6 illustrates another cutterhead support assembly 210 in accordance with the present invention. The cutterhead support assembly 210 in this embodiment has eighteen drive mount stations 211, and is therefore configured to accommodate up to eighteen drive assemblies 105. Other than scale and accommodations for larger numbers of drive assemblies 105, which will be apparent to persons of skill in the art, the cutterhead support assembly 210 is similar to the smaller assembly 110 described above. The cutterhead support assembly 210 is suited to driving larger diameter cutterhead assemblies 102, and through more challenging tunneling environments.

The cutterhead support assemblies 110, 210, and in particular the support structure 120, is a large and expensive component, and requires significant lead time to construct. Prior art cutterhead support structures are designed for a fixed number of drive assemblies, and are typically designed for a single particular project or application. It is not practical for a manufacturer to stock cutterhead support structures for all of the different potential TBM configurations that customers may need, and therefore the lead time for providing a TBM is typically significantly affected by the time required to design and build the cutterhead support assembly. With the present invention, however, a single cutterhead support assembly may be used for a wide range of applications and TBM sizes because the same cutterhead support assembly 110 can be used in different configurations with more or fewer drive assemblies 105. Therefore, it will be much more practical for a manufacturer to stock a small set of cutterhead support structures to accommodate a large number of project needs. For example, a manufacturer may stock one or more cutterhead support assemblies capable of accommodating up to eight drive assemblies, and may stock one or more cutterhead support assemblies sized to accommodate a larger or smaller number of drive assemblies, for example to accommodate up to 32 drive assemblies. The practical ability to stock cutterhead support structures can significantly reduce the lead time required to produce a particular machine.

The present invention allows the manufacturer to determine the number of drive assemblies to be used during the final assembly process, e.g., based on the torque requirements for a given application. This is a major improvement over prior art systems wherein the number of drive assemblies is fixed early in the fabrication stage.

Another significant advantage of the present invention is the ability to repurpose a TBM, or portions of a TBM, for use in other applications. For example, a TBM designed for a particular project in relatively soft ground conditions may be modified for use in a more challenging environment by adding additional drive assemblies, to enable use of the same TBM for a subsequent project. Similarly, if a particular project encounters unexpected obstacles such as more challenging ground conditions, the TBM may be upgraded in the field, with great savings in costs and time.

In particular, a method for repurposing a used tunnel boring machine designed for a first project such that the tunnel boring machine is suitable for use in boring a tunnel for a second project includes acquiring a used tunnel boring machine; modifying the cutterhead support assembly by replacing one or more cradle cover assemblies with pinion housing assemblies; installing one or more drive assemblies wherein each drive assembly includes a motor, a gear box, and a pinion assembly, such that the added pinion assemblies are mounted in the replacement pinion housing assemblies; and using, leasing, or selling the tunnel boring machine for the second project.

In another method for repurposing tunnel boring machine components designed for a first project, it is contemplated that the process includes acquiring a used tunnel boring machine; removing the cutterhead support assembly from the used tunnel boring machine; modifying the cutterhead support assembly by replacing one or more cradle cover assemblies with pinion housing assemblies; and installing the cutterhead support assembly in a second machine having a larger cutterhead assembly, wherein the second machine has more drive assemblies than the used tunnel boring machine.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A tunnel boring machine comprising:

a cutterhead assembly;

a forward shield assembly;

a cutterhead support assembly for rotatably attaching the cutterhead assembly to the forward shield assembly, the cutterhead support assembly comprising (i) a cutterhead support structure comprising a housing portion with a plurality of drive mount stations spaced about a periphery of the housing portion, wherein each drive mount station includes an entry port and a pinion support cradle; (ii) a main bearing assembly; (iii) a plurality of pinion housings, each pinion housing attached to the support structure at one of the plurality of drive mount stations; and (iv) one or more cradle covers attached to the support structure at one of the plurality of drive mount stations, and wherein either (a) one of the plurality of pinion housings, or (b) one of the one or more cradle covers, are attached to the cutterhead support structure at each of the plurality of drive mount stations;

a ring gear attached to the main bearing assembly;

an attachment structure that attaches the cutterhead assembly to the ring gear; and a plurality of drive assemblies, each drive assembly comprising a pinion assembly disposed in one of the plurality of pinion housings and configured to drivably engage the ring gear, and wherein the one or more cradle covers are attached at drive mount stations that do not receive one of the plurality of drive assemblies;

wherein the cutterhead support assembly is configured to engage a variable number of drive assemblies.

2. The tunnel boring machine of claim 1, wherein the forward shield assembly comprises a cylindrical support.

3. The tunnel boring machine of claim 2, wherein the cutterhead support structure further comprises a plurality of plates that extend radially from the housing portion of the support structure to the cylindrical support.

4. The tunnel boring machine of claim 3, further comprising a plurality of shear plates that are fixedly attached to the cylindrical support, wherein the plurality of plates are removably attached to the plurality of shear plates.

5. The tunnel boring machine of claim 4, further comprising a second plurality of shear plates that are fixedly attached to the forward shield assembly, wherein the plurality of plates are removably attached to the second plurality of shear plates.

6. The tunnel boring machine of claim 3, wherein each of the plurality of drive mount stations is disposed between two of the plurality of plates.

7. The tunnel boring machine of claim 1, wherein the cutterhead support assembly is removably mounted in the forward shield assembly.

8. The tunnel boring machine of claim 1, wherein the attachment structure comprises a mounting ring fixed to the ring gear and a plurality of pedestal legs that extend from the mounting ring to the cutterhead assembly.

9. The tunnel boring machine of claim 1, wherein each of the plurality of pinion housings comprises a front plate, a body portion extending rearwardly from the front plate, and a pinion shaft end support extending downwardly from the body portion.

10. The tunnel boring machine of claim 1, wherein the cutterhead support assembly is configured to receive up to eight drive assemblies.

11. The tunnel boring machine of claim 1, wherein the cutterhead support assembly is configured to receive up to eighteen drive assemblies.

12. A cutterhead support assembly for attaching a cutterhead assembly to a tunnel boring machine, the cutterhead support assembly comprising:

(i) a cutterhead support structure comprising a housing portion with a plurality of drive mount stations spaced about a periphery of the housing portion, wherein each drive mount station includes an entry port and a pinion support cradle;

(ii) a main bearing assembly;

(iii) a plurality of pinion housings, each pinion housing attached to the support structure at one of the plurality of drive mount stations; and (iv) one or more cradle covers attached to the support structure at one of the plurality of drive mount stations, and wherein either (a) one of the plurality of pinion housings, or (b) one of the one or more cradle covers, are attached to the cutterhead support structure at each of the plurality of drive mount stations;

wherein the cutterhead support assembly is configured to mount a selectable number of drive assemblies, and further wherein the number of drive assemblies is selectable to accommodate cutterhead assemblies having different diameters.

13. The cutterhead support assembly of claim 12, further comprising a plurality of plates that extend radially from the housing portion.

14. The cutterhead support assembly of claim 13, wherein each of the plurality of drive mount stations is disposed between two of the plurality of plates.

15. The cutterhead support assembly of claim 12, wherein the cutterhead support assembly is configured to be removably mounted in a forward shield assembly of the tunnel boring machine.

16. The cutterhead support assembly of claim 12, wherein each of the plurality of pinion housings comprises a front plate, a body portion extending rearwardly from the front plate, and a pinion shaft end support extending downwardly from the body portion.

17. The cutterhead support assembly of claim 12, wherein the cutterhead support assembly is configured to receive up to eight drive assemblies.

18. The cutterhead support assembly of claim 12, wherein the cutterhead support assembly is configured to receive up to eighteen drive assemblies.

19. A method of repurposing a tunnel boring machine comprising:

obtaining a tunnel boring machine having a first plurality of drive assemblies that engage a cutterhead support assembly for rotatably driving a cutterhead assembly; and modifying the tunnel boring machine by installing at least one additional drive assembly for rotatably driving the cutterhead assembly such that the tunnel boring machine is configured to rotatably drive the cutterhead assembly with a greater torque;

wherein the at least one additional drive assembly comprises a motor-driven pinion assembly, and further wherein the step of installing the at least one additional drive assembly comprises replacing a cradle cover on the cutterhead support assembly with a pinion housing, and installing the drive assembly such that the motor-driven pinion assembly is disposed in the pinion housing and configured to engage a drive ring.

* * * * *